US009193913B2

(12) United States Patent
Quanci et al.

(10) Patent No.: US 9,193,913 B2
(45) **Date of Patent: *Nov. 24, 2015**

(54) REDUCED OUTPUT RATE COKE OVEN OPERATION WITH GAS SHARING PROVIDING EXTENDED PROCESS CYCLE

(71) Applicant: SunCoke Technology and Development LLC., Lisle, IL (US)

(72) Inventors: John Francis Quanci, Haddonfield, NJ (US); Ashley Nicole Seaton, Chicago, IL (US); Mark Anthony Ball, Richlands, VA (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 384 days.

This patent is subject to a terminal disclaimer.

(21) Appl. No.: 13/730,692

(22) Filed: Dec. 28, 2012

(65) Prior Publication Data

US 2014/0083836 A1 Mar. 27, 2014

Related U.S. Application Data

(60) Provisional application No. 61/704,389, filed on Sep. 21, 2012.

(51) Int. Cl.
*C10B 21/00* (2006.01)
*C10B 27/06* (2006.01)
(Continued)

(52) U.S. Cl.
CPC ..... *C10B 21/00* (2013.01); *C10B 15/02* (2013.01); *C10B 21/08* (2013.01); *C10B 21/10* (2013.01);
(Continued)

(58) Field of Classification Search
CPC ..... C10B 5/00; C10B 5/06; C10B 5/10; C10B 27/00; C10B 27/06; C10B 21/04; C10B 21/08
See application file for complete search history.

(56) References Cited

U.S. PATENT DOCUMENTS 1,469,868 A 3/1892 Thomas et al.
1,140,798 A 5/1915 Carpenter
(Continued)

FOREIGN PATENT DOCUMENTS

CA 2775992 A1 5/2011
CA 2822857 7/2012
(Continued)

OTHER PUBLICATIONS

JP 03-197588, Inoqu Keizo et al., Method and Equipment for Boring Degassing Hole in Coal Charge in Coke Oven, Japanese Patent (Abstract Only) Aug. 28, 1991.
(Continued)

*Primary Examiner* — In Suk Bullock
*Assistant Examiner* — Jonathan L Pilcher
(74) *Attorney, Agent, or Firm* — Perkins Coie LLP

(57) ABSTRACT

The present technology is generally directed to systems and methods of controlling or reducing the output rate of a coke oven through gas sharing providing an extended process cycle. In some embodiments, a method of gas sharing between coke ovens to decrease a coke production rate includes operating a plurality of coke ovens to produce coke and heated exhaust gases. In some embodiments, a first coke oven is offset in operation cycle from a second coke oven. The method further includes directing the heated exhaust gases from the first coke oven to the second coke oven while the second coke oven is mid-cycle. The heat transfer allows the second coke oven to extend its cycle while staying above a critical operating temperature. By extending the operational cycle while generally maintaining output per cycle, overall production is decreased.

23 Claims, 6 Drawing Sheets

(51) Int. Cl.

| | |
|---|---|
| ***C10B 21/08*** | (2006.01) |
| ***C10B 49/02*** | (2006.01) |
| ***C10B 27/00*** | (2006.01) |
| ***C10B 15/02*** | (2006.01) |
| ***C10B 21/10*** | (2006.01) |
| ***C10B 41/08*** | (2006.01) |
| *C10B 5/00* | (2006.01) |
| *C10B 5/06* | (2006.01) |
| *C10B 5/10* | (2006.01) |

(52) U.S. Cl.

CPC ..... *C10B 27/00* (2013.01); *C10B 27/06* (2013.01); *C10B 41/08* (2013.01); *C10B 49/02* (2013.01); *C10B 5/00* (2013.01); *C10B 5/06* (2013.01); *C10B 5/10* (2013.01)

(56) References Cited

U.S. PATENT DOCUMENTS

| | | | | |
|---|---|---|---|---|
| 1,424,777 | A | | 8/1922 | Schondeling |
| 1,430,027 | A | | 9/1922 | Plantinga |
| 1,572,391 | A | | 2/1926 | Klaiber |
| 1,721,813 | A | | 7/1929 | Geipert et al. |
| 1,818,370 | A | | 8/1931 | Wine |
| 1,848,818 | A | | 3/1932 | Becker |
| 1,955,962 | A | | 4/1934 | Jones |
| 2,394,173 | A | | 2/1946 | Harris et al. |
| 2,424,012 | A | | 7/1947 | Bangham et al. |
| 2,902,991 | A | | 9/1959 | Whitman |
| 3,033,764 | A | | 5/1962 | Hannes |
| 3,462,345 | A | | 8/1969 | Kernan |
| 3,545,470 | A | | 12/1970 | Paton |
| 3,616,408 | A | | 10/1971 | Hickam |
| 3,630,852 | A | | 12/1971 | Nashan et al. |
| 3,652,403 | A | | 3/1972 | Knappstein et al. |
| 3,676,305 | A | | 7/1972 | Cremer |
| 3,709,794 | A | | 1/1973 | Kinzler et al. |
| 3,746,626 | A | | 7/1973 | Morrison, Jr. |
| 3,748,235 | A | | 7/1973 | Pries |
| 3,784,034 | A | | 1/1974 | Thompson |
| 3,806,032 | A | | 4/1974 | Pries |
| 3,836,161 | A | | 9/1974 | Buhl |
| 3,839,156 | A | | 10/1974 | Jakobi et al. |
| 3,857,758 | A | | 12/1974 | Mole |
| 3,875,016 | A | * | 4/1975 | Schmidt-Balve et al. .... 202/151 |
| 3,876,506 | A | | 4/1975 | Dix et al. |
| 3,878,053 | A | | 4/1975 | Hyde |
| 3,897,312 | A | | 7/1975 | Armour et al. |
| 3,906,992 | A | | 9/1975 | Leach |
| 3,912,091 | A | | 10/1975 | Thompson |
| 3,917,458 | A | | 11/1975 | Polak |
| 3,930,961 | A | | 1/1976 | Sustarsic et al. |
| 3,957,591 | A | | 5/1976 | Riecker |
| 3,963,582 | A | | 6/1976 | Helm et al. |
| 3,969,191 | A | | 7/1976 | Bollenbach |
| 3,984,289 | A | | 10/1976 | Sustarsic et al. |
| 4,004,702 | A | | 1/1977 | Szendroi |
| 4,004,983 | A | | 1/1977 | Pries |
| 4,040,910 | A | | 8/1977 | Knappstein et al. |
| 4,059,885 | A | | 11/1977 | Oldengott |
| 4,067,462 | A | | 1/1978 | Thompson |
| 4,083,753 | A | | 4/1978 | Rogers et al. |
| 4,086,231 | A | | 4/1978 | Ikio |
| 4,100,033 | A | | 7/1978 | Holter |
| 4,111,757 | A | | 9/1978 | Ciarimboli |
| 4,124,450 | A | | 11/1978 | MacDonald |
| 4,141,796 | A | | 2/1979 | Clark et al. |
| 4,145,195 | A | | 3/1979 | Knappstein et al. |
| 4,147,230 | A | | 4/1979 | Ormond et al. |
| 4,189,272 | A | | 2/1980 | Gregor et al. |
| 4,194,951 | A | | 3/1980 | Pries |
| 4,196,053 | A | | 4/1980 | Grohmann |
| 4,211,608 | A | | 7/1980 | Kwasnoski et al. |
| 4,213,489 | A | | 7/1980 | Cain |
| 4,222,748 | A | | 9/1980 | Argo et al. |
| 4,225,393 | A | | 9/1980 | Gregor et al. |
| 4,235,830 | A | | 11/1980 | Bennett et al. |
| 4,248,671 | A | | 2/1981 | Belding |
| 4,249,997 | A | | 2/1981 | Schmitz |
| 4,263,099 | A | | 4/1981 | Porter |
| 4,285,772 | A | | 8/1981 | Kress |
| 4,287,024 | A | | 9/1981 | Thompson |
| 4,289,584 | A | | 9/1981 | Chuss et al. |
| 4,289,585 | A | | 9/1981 | Wagener et al. |
| 4,303,615 | A | | 12/1981 | Jarmell et al. |
| 4,307,673 | A | | 12/1981 | Caughey |
| 4,330,372 | A | | 5/1982 | Cairns et al. |
| 4,334,963 | A | | 6/1982 | Stog |
| 4,336,843 | A | | 6/1982 | Petty |
| 4,340,445 | A | | 7/1982 | Kucher et al. |
| 4,342,195 | A | | 8/1982 | Lo |
| 4,344,820 | A | | 8/1982 | Thompson |
| 4,366,029 | A | | 12/1982 | Bixby et al. |
| 4,372,840 | A | | 2/1983 | Bearden et al. |
| 4,373,244 | A | | 2/1983 | Mertens et al. |
| 4,375,388 | A | | 3/1983 | Hara et al. |
| 4,391,674 | A | | 7/1983 | Velmin et al. |
| 4,392,824 | A | | 7/1983 | Struck et al. |
| 4,395,269 | A | | 7/1983 | Schuler |
| 4,396,394 | A | | 8/1983 | Li et al. |
| 4,396,461 | A | | 8/1983 | Neubaum et al. |
| 4,431,484 | A | | 2/1984 | Weber et al. |
| 4,439,277 | A | | 3/1984 | Dix |
| 4,445,977 | A | | 5/1984 | Husher |
| 4,446,018 | A | | 5/1984 | Cerwick |
| 4,448,541 | A | | 5/1984 | Wirtschafter |
| 4,452,749 | A | | 6/1984 | Kolvek et al. |
| 4,459,103 | A | | 7/1984 | Gieskieng |
| 4,465,557 | A | | 8/1984 | Blase et al. |
| 4,469,446 | A | | 9/1984 | Goodboy |
| 4,498,786 | A | | 2/1985 | Ruscheweyh |
| 4,527,488 | A | | 7/1985 | Lindgren |
| 4,568,426 | A | | 2/1986 | Orlando et al. |
| 4,570,670 | A | | 2/1986 | Johnson |
| 4,614,567 | A | | 9/1986 | Stahlherm et al. |
| 4,643,803 | A | | 2/1987 | Thijssen et al. |
| 4,645,513 | A | | 2/1987 | Kubota et al. |
| 4,655,193 | A | | 4/1987 | Blacket |
| 4,655,804 | A | | 4/1987 | Kercheval et al. |
| 4,680,167 | A | | 7/1987 | Orlando et al. |
| 4,704,195 | A | | 11/1987 | Janicka et al. |
| 4,720,262 | A | | 1/1988 | Durr et al. |
| 4,726,465 | A | | 2/1988 | Kwasnik et al. |
| 4,929,179 | A | | 5/1990 | Breidenbach et al. |
| 4,941,824 | A | | 7/1990 | Holter et al. |
| 5,052,922 | A | | 10/1991 | Stokman et al. |
| 5,062,925 | A | | 11/1991 | Durselen et al. |
| 5,078,822 | A | | 1/1992 | Hodges et al. |
| 5,114,542 | A | * | 5/1992 | Childress et al. ..... 201/15 |
| 5,227,106 | A | | 7/1993 | Kolvek |
| 5,318,671 | A | | 6/1994 | Pruitt |
| 5,670,025 | A | | 9/1997 | Baird |
| 5,928,476 | A | | 7/1999 | Daniels |
| 5,968,320 | A | | 10/1999 | Sprague |
| 6,017,214 | A | | 1/2000 | Sturgulewski |
| 6,059,932 | A | | 5/2000 | Sturgulewski |
| 6,139,692 | A | | 10/2000 | Tamura et al. |
| 6,152,668 | A | | 11/2000 | Knoch |
| 6,187,148 | B1 | | 2/2001 | Sturgulewski |
| 6,189,819 | B1 | | 2/2001 | Racine |
| 6,290,494 | B1 | | 9/2001 | Barkdoll |
| 6,596,128 | B2 | | 7/2003 | Westbrook |
| 6,626,984 | B1 | | 9/2003 | Taylor |
| 6,699,035 | B2 | | 3/2004 | Brooker |
| 6,758,875 | B2 | | 7/2004 | Reid et al. |
| 6,907,895 | B2 | | 6/2005 | Johnson et al. |
| 6,946,011 | B2 | | 9/2005 | Snyder |
| 7,056,390 | B2 | | 6/2006 | Fratello et al. |
| 7,077,892 | B2 | | 7/2006 | Lee |
| 7,314,060 | B2 | | 1/2008 | Chen et al. |
| 7,331,298 | B2 | | 2/2008 | Taylor et al. |
| 7,497,930 | B2 | * | 3/2009 | Barkdoll et al. ..... 201/41 |
| 7,611,609 | B1 | | 11/2009 | Valia et al. |

(56) References Cited

U.S. PATENT DOCUMENTS

| | | | | |
|---|---|---|---|---|
| 7,644,711 | B2 | 1/2010 | Creel | |
| 7,727,307 | B2 | 6/2010 | Winkler | |
| 7,803,627 | B2 | 9/2010 | Hodges | |
| 7,827,689 | B2 | 11/2010 | Crane et al. | |
| 7,998,316 | B2 | 8/2011 | Barkdoll et al. | |
| 8,071,060 | B2 | 12/2011 | Ukai et al. | |
| 8,079,751 | B2 | 12/2011 | Kapila et al. | |
| 8,152,970 | B2 | 4/2012 | Barkdoll et al. | |
| 8,236,142 | B2 | 8/2012 | Westbrook et al. | |
| 8,266,853 | B2 | 9/2012 | Bloom et al. | |
| 8,398,935 | B2 | 3/2013 | Howell, Jr. et al. | |
| 2002/0134659 | A1* | 9/2002 | Westbrook | 202/254 |
| 2006/0102420 | A1 | 5/2006 | Huber et al. | |
| 2008/0169578 | A1 | 7/2008 | Crane et al. | |
| 2008/0179165 | A1 | 7/2008 | Chen et al. | |
| 2008/0271985 | A1 | 11/2008 | Yamasaki | |
| 2009/0217576 | A1 | 9/2009 | Kim et al. | |
| 2009/0283395 | A1 | 11/2009 | Hippe | |
| 2010/0095521 | A1 | 4/2010 | Bertini et al. | |
| 2010/0115912 | A1 | 5/2010 | Worley | |
| 2010/0287871 | A1 | 11/2010 | Bloom et al. | |
| 2011/0048917 | A1 | 3/2011 | Kim et al. | |
| 2011/0223088 | A1 | 9/2011 | Chang et al. | |
| 2011/0253521 | A1* | 10/2011 | Kim | 201/17 |
| 2012/0024688 | A1 | 2/2012 | Barkdoll | |
| 2012/0030998 | A1 | 2/2012 | Barkdoll et al. | |
| 2012/0152720 | A1* | 6/2012 | Reichelt et al. | 201/27 |
| 2012/0228115 | A1 | 9/2012 | Westbrook | |
| 2013/0216717 | A1 | 8/2013 | Rago et al. | |
| 2013/0306462 | A1 | 11/2013 | Kim et al. | |
| 2014/0033917 | A1 | 2/2014 | Rodgers et al. | |
| 2014/0048402 | A1 | 2/2014 | Quanci et al. | |
| 2014/0048404 | A1 | 2/2014 | Quanci et al. | |
| 2014/0048405 | A1 | 2/2014 | Quanci et al. | |
| 2014/0061018 | A1 | 3/2014 | Sarpen et al. | |
| 2014/0182195 | A1 | 7/2014 | Quanci et al. | |
| 2014/0182683 | A1 | 7/2014 | Quanci et al. | |
| 2014/0183023 | A1 | 7/2014 | Quanci et al. | |
| 2014/0183024 | A1 | 7/2014 | Chun et al. | |
| 2014/0183026 | A1 | 7/2014 | Quanci et al. | |
| 2014/0262139 | A1 | 9/2014 | Choi et al. | |
| 2014/0262726 | A1 | 9/2014 | West et al. | |
| 2015/0122629 | A1 | 5/2015 | Freimuth et al. | |
| 2015/0247092 | A1 | 9/2015 | Quanci et al. | |

FOREIGN PATENT DOCUMENTS

| | | | |
|---|---|---|---|
| CN | 2064363 | U | 10/1990 |
| CN | 1092457 | A | 9/1994 |
| CN | 1255528 | A | 6/2000 |
| CN | 1358822 | A | 7/2002 |
| CN | 2509188 | Y | 9/2002 |
| CN | 2528771 | Y | 1/2003 |
| CN | 1468364 | A | 1/2004 |
| CN | 2668641 | Y | 1/2005 |
| CN | 202226816 | U | 5/2012 |
| DE | 212176 | C | 7/1909 |
| DE | 3315738 | A1 | 11/1983 |
| DE | 3329367 | C1 | 11/1984 |
| DE | 19545736 | A1 | 6/1997 |
| DE | 19803455 | C1 | 8/1999 |
| DE | 10154785 | A1 | 5/2003 |
| DE | 102009031436 | | 1/2011 |
| DE | 102011052785 | B3 | 12/2012 |
| EP | 0066018 | | 12/1982 |
| FR | 2339664 | A1 | 8/1977 |
| GB | 441784 | A | 1/1936 |
| GB | 606340 | A | 8/1948 |
| GB | 611524 | A | 11/1948 |
| GB | 725865 | A | 3/1955 |
| GB | 871094 | A | 6/1961 |
| JP | S50148405 | | 11/1975 |
| JP | 54054101 | A | 4/1979 |
| JP | 57051786 | A | 3/1982 |
| JP | 57051787 | A | 3/1982 |
| JP | 57083585 | A | 5/1982 |
| JP | 57090092 | A | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 61106690 | A | 5/1986 |
| JP | 62011794 | A | 1/1987 |
| JP | 62285980 | A | 12/1987 |
| JP | 01103694 | A | 4/1989 |
| JP | 01249886 | A | 10/1989 |
| JP | H0319127 | A | 1/1991 |
| JP | 07188668 | A | 7/1995 |
| JP | 07216357 | A | 8/1995 |
| JP | 08127778 | A | 5/1996 |
| JP | 2001200258 | A | 7/2001 |
| JP | 03197588 | A | 8/2001 |
| JP | 2002106941 | A | 4/2002 |
| JP | 200341258 | A | 2/2003 |
| JP | 2003071313 | A | 3/2003 |
| JP | 04159392 | A | 10/2008 |
| JP | 2009144121 | A | 7/2009 |
| JP | 2012102302 | A | 5/2012 |
| KR | 960008754 | Y1 | 10/1996 |
| KR | 1019990054426 | A | 7/1999 |
| KR | 100296700 | B1 | 10/2001 |
| KR | 100797852 | B1 | 1/2008 |
| KR | 1020110010452 | A | 2/2011 |
| KR | 101318388 | B1 | 10/2013 |
| WO | WO-9012074 | A1 | 10/1990 |
| WO | WO-9945083 | A1 | 9/1999 |
| WO | WO-2007103649 | A2 | 9/2007 |
| WO | WO-2008034424 | A1 | 3/2008 |
| WO | WO-2010107513 | A1 | 9/2010 |
| WO | WO-2011000447 | A1 | 1/2011 |
| WO | WO-2012029979 | A1 | 3/2012 |
| WO | WO-2013023872 | A1 | 2/2013 |

OTHER PUBLICATIONS

JP 04-159392, Inoue Keizo et al., Method and Equipment for Opening Hole for Degassing of Coal Charge in Coke Oven, Japanese Patent (Abstract Only) Jun. 2, 1992.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

International Search Report and Written Opinion of International Application No. PCT/US2012/072169; Date of Mailing: Jun. 10, 2013; 10 pages.

International Search Report and Written Opinion issued for PCT/US2012/072169 and mailed on Jun. 10, 2013, 10 pages.

ASTM D5341-99(2010)e1, Standard Test Method for Measuring Coke Reactivity Index (CRI) and Coke Strength After Reaction (CSR), ASTM International, West Conshohocken, PA, 2010.

Canada Office Action in Canadian Application No. 2754737, Mailing Date Mar. 21, 2013, 2 pages.

Clean coke process: process development studies by USS Engineers and Consultants, Inc., Wisconsin Tech Search, request date Oct. 5, 2011, 17 pages.

Rose, Harold J., "The Selection of Coals for the Manufacture of Coke," American Institute of Mining and Metallurgical Engineers, Feb. 1926, 8 pages.

U.S. Appl. No. 14/839,384, filed Aug. 28, 2015, Quanci et al.

U.S. Appl. No. 14/839,493, filed Aug. 28, 2015, Quanci et al.

U.S. Appl. No. 14/839,551, filed Aug. 28, 2015, Quanci et al.

U.S. Appl. No. 14/839,588, filed Aug. 28, 2015, Quanci et al.

U.S. Appl. No. 14/865,581, filed Sep. 25, 2015, Sarpen et al.

* cited by examiner

REDUCED OUTPUT RATE COKE OVEN OPERATION WITH GAS SHARING PROVIDING EXTENDED PROCESS CYCLE

CROSS-REFERENCE TO RELATED APPLICATION

This application claims the benefit of U.S. Provisional Application No. 61/704,389, filed Sep. 21, 2012, which is incorporated herein by reference in its entirety.

TECHNICAL FIELD

The present technology is generally directed to systems and methods of reducing the output rate of coke oven operation through gas sharing providing extended process cycle.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for 24 to 48 hours under closely-controlled atmospheric conditions. Coking ovens have been used for many years to covert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

The melting and fusion process undergone by the coal particles during the heating process is an important part of coking. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens, and the coal is heated in the ovens in order to remove volatile matter ("VM") from the resulting coke. The coking process is highly dependent on the oven design, the type of coal, and conversion temperature used. Typically, ovens are adjusted during the coking process so that each charge of coal is coked out in approximately the same amount of time. Once the coal is "coked out" or fully coked, the coke is removed from the oven and quenched with water to cool it below its ignition temperature. Alternatively, the coke is dry quenched with an inert gas. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type or vertical ovens, the coal is typically charged through slots or openings in the top of the ovens. Such ovens tend to be tall and narrow. Horizontal non-recovery or heat recovery type coking ovens are also used to produce coke. In the non-recovery or heat recovery type coking ovens, conveyors are used to convey the coal particles horizontally into the ovens to provide an elongate bed of coal.

As the source of coal suitable for forming metallurgical coal ("coking coal") has decreased, attempts have been made to blend weak or lower quality coals ("non-coking coal") with coking coals to provide a suitable coal charge for the ovens. One way to combine non-coking and coking coals is to use compacted or stamp-charged coal. The coal may be compacted before or after it is in the oven. In some embodiments, a mixture of non-coking and coking coals is compacted to greater than fifty pounds per cubic foot in order to use non-coking coal in the coke making process. As the percentage of non-coking coal in the coal mixture is increased, higher levels of coal compaction are required (e.g., up to about sixty-five to seventy-five pounds per cubic foot). Commercially, coal is typically compacted to about 1.15 to 1.2 specific gravity (sg) or about 70-75 pounds per cubic foot.

Horizontal Heat Recovery (HHR) ovens have a unique environmental advantage over chemical byproduct ovens based upon the relative operating atmospheric pressure conditions inside HHR ovens. HHR ovens operate under negative pressure whereas chemical byproduct ovens operate at a slightly positive atmospheric pressure. Both oven types are typically constructed of refractory bricks and other materials in which creating a substantially airtight environment can be a challenge because small cracks can form in these structures during day-to-day operation. Chemical byproduct ovens are kept at a positive pressure to avoid oxidizing recoverable products and overheating the ovens. Conversely, HHR ovens are kept at a negative pressure, drawing in air from outside the oven to oxidize the coal's VM and to release the heat of combustion within the oven. It is important to minimize the loss of volatile gases to the environment, so the combination of positive atmospheric conditions and small openings or cracks in chemical byproduct ovens allow raw coke oven gas ("COG") and hazardous pollutants to leak into the atmosphere. Conversely, the negative atmospheric conditions and small openings or cracks in the HHR ovens or locations elsewhere in the coke plant simply allow additional air to be drawn into the oven or other locations in the coke plant so that the negative atmospheric conditions resist the loss of COG to the atmosphere.

HHR ovens have traditionally been unable to turn down their operation (e.g., their coke production) significantly below their designed capacity without potentially damaging the ovens. This restraint is linked to temperature limitations in the ovens. More specifically, if the ovens drop below the silica brick zero-expansion point, the oven bricks can start to contract and potentially crack or break and damage the oven crown. The bricks could also potentially shrink on cooling, with bricks in the arched crown moving or falling out, leading to a collapsed crown and oven failure. Enough heat must be maintained in the ovens to keep the brick above the brick contraction point. This is the reason why it has been stated that a HHR oven can never be turned off. Because the ovens cannot be significantly turned down, during periods of low steel and coke demand, coke production must be sustained. The continuous, high-volume coke production despite low demand leads to build up of excess coke. This coke must be stored or wasted and can lead to a large economic burden and loss to coke and steel plants.

DETAILED DESCRIPTION

The present technology is generally directed to systems and methods of controlling or reducing the output rate of coke ovens through gas sharing providing extended process cycle. In some embodiments, a method of gas sharing between coke ovens to decrease a coke production rate includes operating a plurality of coke ovens to produce coke and exhaust gases, wherein each coke oven can comprise an uptake damper adapted to control an oven draft in the coke oven. In some embodiments, a first coke oven is offset in operation cycle from a second coke oven. The method includes directing the exhaust gases from the first coke oven to a shared gas duct that is in communication with second coke oven. The method additionally includes biasing the draft in the ovens to move the exhaust gas from the first coke oven to the second coke oven via the shared gas duct to transfer heat from the first coke oven to the second coke oven. The heat transfer allows the second coke oven to extend its cycle while staying above a critical operating temperature. By extending the operational cycle while generally maintaining output per cycle, overall production is decreased.

Specific details of several embodiments of the technology are described below with reference to FIGS. 1-6. Other details describing well-known structures and systems often associated with coal processing have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-6.

Figure 1:
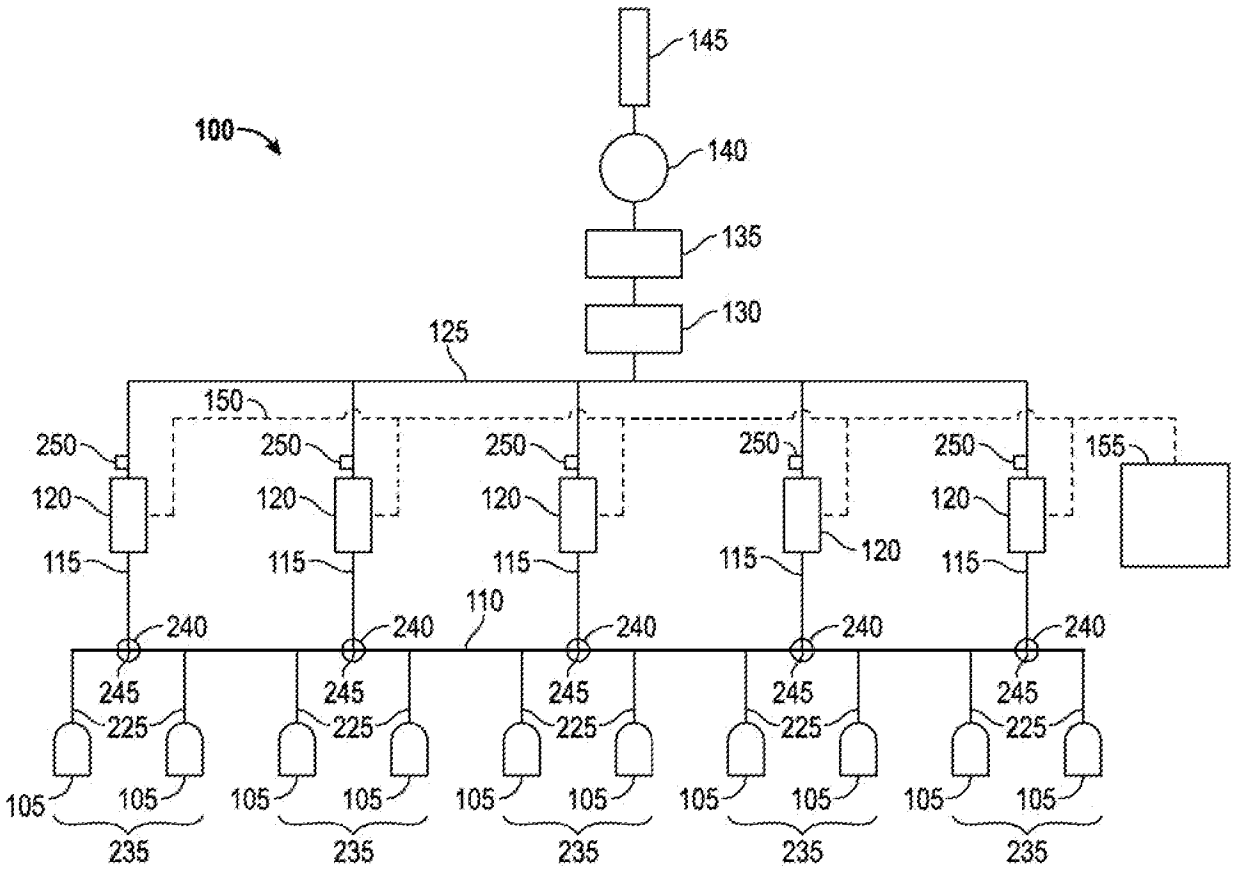
FIG. 1 is a schematic illustration of a horizontal heat recovery coke plant, configured in accordance with embodiments of the technology.

FIG. 1 is a schematic illustration of a horizontal heat recovery (HHR) coke plant 100, configured in accordance with embodiments of the technology. The HHR coke plant 100 comprises ovens 105, along with heat recovery steam generators (HRSGs) 120 and an air quality control system 130 (e.g., an exhaust or flue gas desulfurization (FGD) system), both of which are positioned fluidly downstream from the ovens 105 and both of which are fluidly connected to the ovens 105 by suitable ducts. The HHR coke plant 100 also includes a common tunnel 110 fluidly connecting individual ovens 105 to the HRSGs 120. One or more crossover ducts 115 fluidly connect the common tunnel 110 to the HRSGs 120. A cooled gas duct 125 transports the cooled gas from the HRSGs to the flue gas desulfurization (FGD) system 130. Fluidly connected and further downstream are a baghouse 135 for collecting particulates, at least one draft fan 140 for controlling air pressure within the system, and a main gas stack 145 for exhausting cooled, treated exhaust to the environment. Steam lines 150 can interconnect the HRSG 120 and a cogeneration plant 155 so that the recovered heat can be utilized. Various coke plants 100 can have different proportions of ovens 105, HRSGs 120, and other structures. For example, in some coke plants, each oven 105 illustrated in FIG. 1 can represent ten actual ovens.

As will be described in further detail below, in several embodiments the coke ovens 105 can operate on an "extended" cycle compared to the traditional Thompson Coking Process described above. Implementing an extended cycle schedule while keeping oven temperatures sufficiently high can be accomplished using various techniques. In several embodiments, the cycle can be extended by using oven gas sharing to transfer heat between ovens. The ovens that share heat can be pushed on offset (e.g., opposite) cycles. For example, if the ovens have a 96 hour extended cycle, a first oven is pushed 48 hours into a second oven's cycle. As will be described in further detail below, by pushing ovens at opposite times, a coke plant can move excess VM and flue gas from a newly pushed oven to an oven that is cooling. This can be done by biasing the draft in the ovens to move the VM and flue gas from the hotter to the cooler oven. When gas sharing is employed, the oven that is cooling off begins to reheat, which extends its cycle. As will be described in further detail below, in several embodiments the gas sharing can be implemented using advanced control mechanisms to bias the oven drafts.

The extended cycle through gas-sharing technique can be used alone or combined with other cycle-extension techniques to optimize the extended cycle while maintaining operating temperature. For example, in some embodiments, maximizing coal charge leads to requiring higher hours/ton to process the coal, which extends the coal cycle length per coke output. At the same time, it allows the coke plant to have more fuel per volatile matter to use in extending the cycle. In further embodiments, the cycle can be extended by lowering the oven operating temperature which slows the coke rate. In still further embodiments, the cycle can be extended by closing off air leaks or locking in the oven to prevent undesirable oven cooling. In some embodiments, extra insulation can be added to the oven (e.g., to the oven crown). Refractory blankets can likewise be used to lower oven heat loss. In still further embodiments, an external heat source, such as a supplemental fuel (e.g., natural gas), can be used to add heat to a cooling oven to extend the oven's cycle. The natural gas can keep the oven temperature high enough to prevent damage to the silica bricks. In other embodiments, the cycle can be extended without supplemental fuel.

In further embodiments, coal properties or quantity can be adjusted to reduce output. For example, coal having a high-VM percentage compared to typical coking coal can be used as a means to extend the cycle length and maintain oven temperature. Normally, high VM coal cannot be used, as it can overheat the oven. If the oven is running on an extended cycle at a lower temperature, however, the VM of the coal can be higher while maintaining oven integrity and the quality of the coke output. High VM coal can also be cheaper and can lead to lower coke yield than typical coking coal. In some embodiments, coal having a 26% or higher VM (percentage by weight) or 30% or higher VM can be used.

In further embodiments, a reduced output can be achieved by pushing a "short fill" (i.e., a reduced coal load as compared to the designed fill) on a standard, slightly decreased, or extended cycle time (i.e., as compared to the designed cycle time) as a way to reduce output. In a particular embodiment, a short fill comprises using around a 28 metric ton fill in an oven designed for a 43 metric ton fill. In other embodiments, the coke production rate can be decreased 10-40% as compared to the maximum designed production rate (i.e., the maximum designed fill over the maximum designed cycle time). In particular embodiments, the coke production rate is decreased at least 15%. Pushing a short fill can be used as a stand-alone strategy or in conjunction with any of the cycle-extension techniques described above.

The cycle can be extended to various lengths to accommodate a particular level of coke demand (i.e., longer cycles lead to lower coke production). For example, coke ovens can run on 72 hour, 96 hour, 108 hour, 120 hour, 144 hour, or other extended cycles to decrease coke output while maintaining oven temperature and corresponding oven integrity. By extending the cycle from 48 to 96 hours, for example, coke production can be approximately halved. In some embodiments, the cycle length can be set to run on a multiple of 12 or 24 hours, to accommodate plant scheduling.

Figure 2:
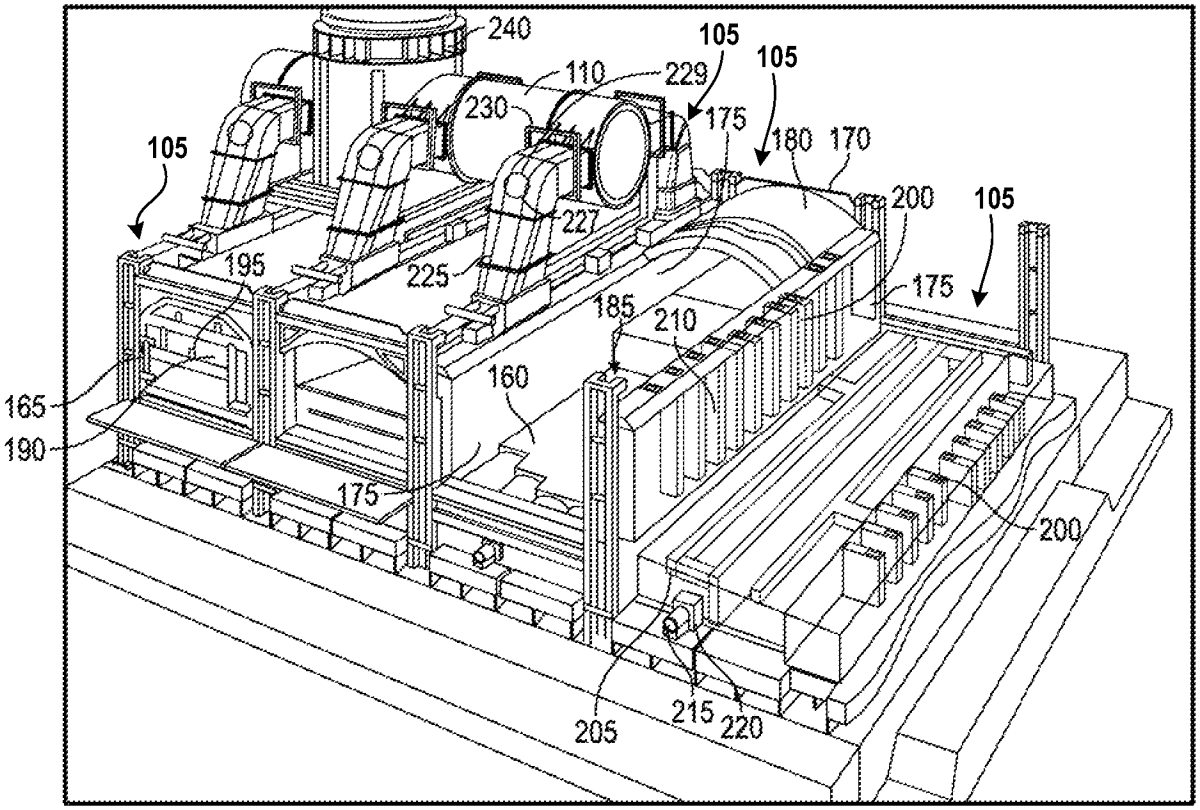
FIG. 2 is an isometric, partial cut-away view of a portion of the horizontal heat recovery coke plant of FIG. 1 configured in accordance with embodiments of the technology.
Figure 3:
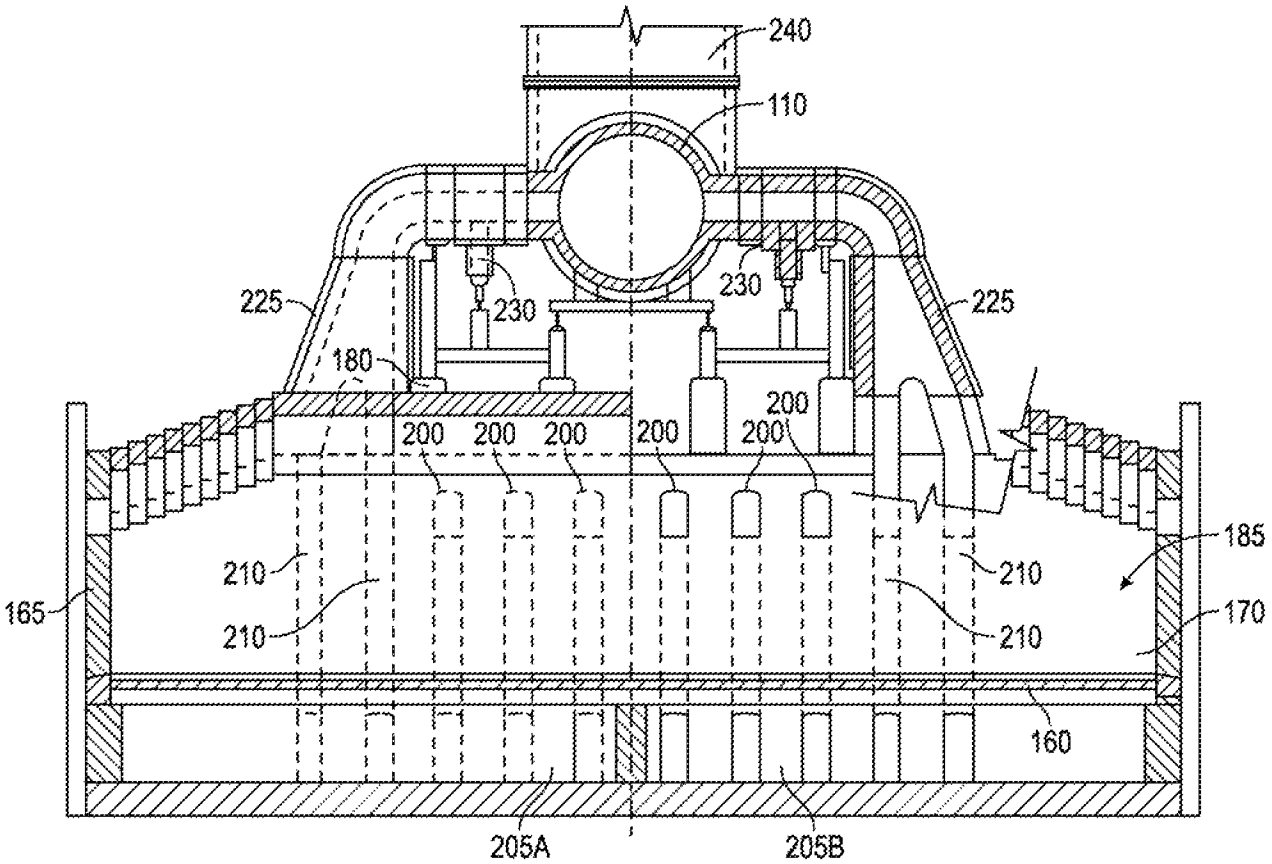
FIG. 3 is a sectional view of a horizontal heat recovery coke oven configured in accordance with embodiments of the technology.
Figure 4:
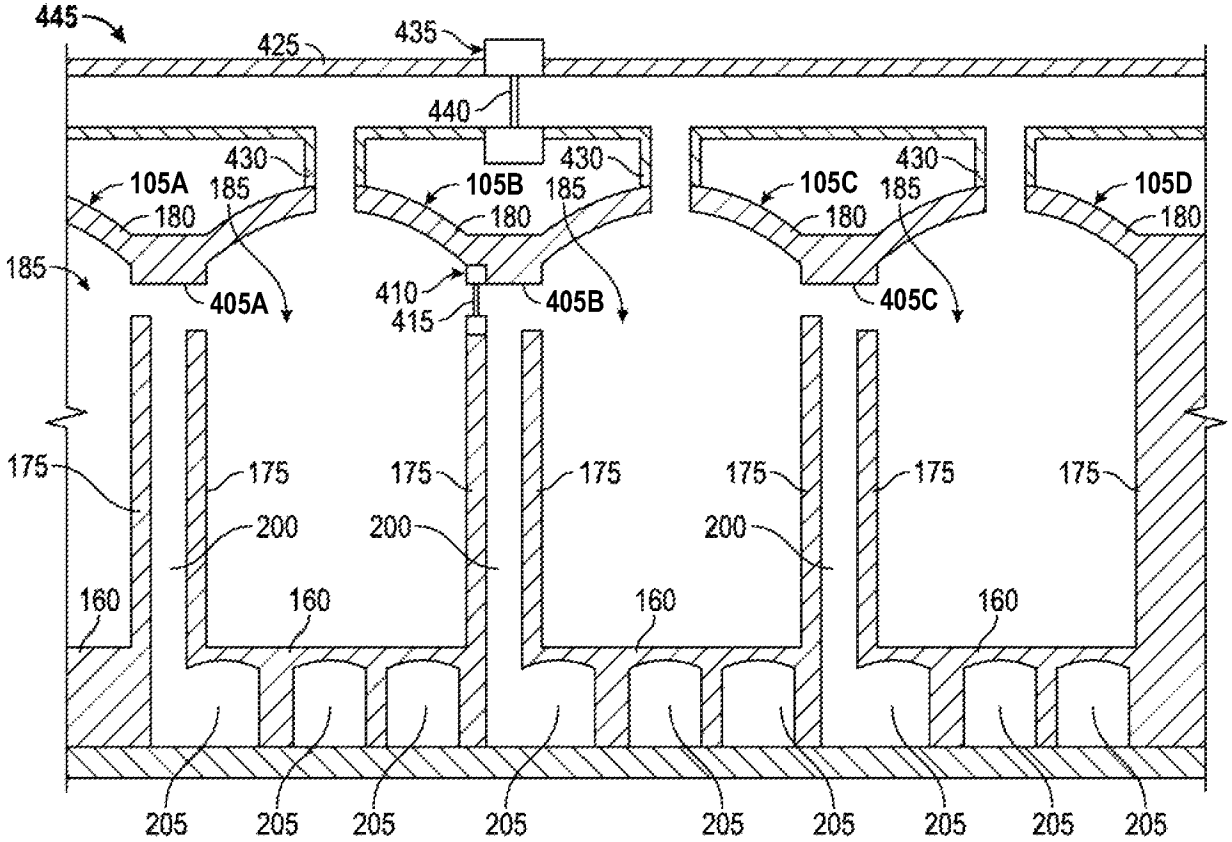
FIG. 4 is a sectional view of a volatile matter/flue gas sharing system configured in accordance with embodiments of the technology.

FIGS. 2-4 illustrate further details related to the structure and mechanics of gas sharing between ovens. FIG. 2 is an isometric, partial cut-away view of a portion of the HHR coke plant 100 of FIG. 1 configured in accordance with embodiments of the technology. FIG. 3 is a sectional view of an HHR coke oven 105 configured in accordance with embodiments of the technology. Referring to FIGS. 2 and 3 together, each oven 105 can include an open cavity defined by a floor 160, a front door 165 forming substantially the entirety of one side of the oven, a rear door 170 opposite the front door 165 forming substantially the entirety of the side of the oven opposite the front door, two sidewalls 175 extending upwardly from the floor 160 intermediate the front 165 and rear 170 doors, and a crown 180 which forms the top surface of the open cavity of an oven chamber 185. Controlling air flow and pressure inside the oven chamber 185 can be critical to the efficient operation of the coking cycle and therefore the front door 165 includes one or more primary air inlets 190 that allow primary combustion air into the oven chamber 185. Each primary air inlet 190 includes a primary air damper 195 which can be positioned at any of a number of positions between fully open and fully closed to vary the amount of primary air flow into the oven chamber 185. Alternatively, the one or more primary air inlets 190 are formed through the crown 180.

In operation, volatile gases emitted from the coal positioned inside the oven chamber 185 collect in the crown and are drawn downstream in the overall system into downcomer channels 200 formed in one or both sidewalls 175. The downcomer channels fluidly connect the oven chamber 185 with a sole flue 205 positioned beneath the over floor 160. The sole flue 205 forms a circuitous path beneath the oven floor 160. Volatile gases emitted from the coal can be combusted in the sole flue 205 thereby generating heat to support the reduction of coal into coke. The downcomer channels 200 are fluidly connected to chimneys or uptake channels 210 formed in one or both sidewalls 175. A secondary air inlet 215 is provided between the sole flue 205 and atmosphere and the secondary air inlet 215 includes a secondary air damper 220 that can be positioned at any of a number of positions between fully open and fully closed to vary the amount of secondary air flow into the sole flue 205. The uptake channels 210 are fluidly connected to the common tunnel 110 by one or more uptake ducts 225. A tertiary air inlet 227 is provided between the uptake duct 225 and atmosphere. The tertiary air inlet 227 includes a tertiary air damper 229 which can be positioned at any of a number of positions between fully open and fully closed to vary the amount of tertiary air flow into the uptake duct 225.

In order to provide the ability to control gas flow through the uptake ducts 225 and within the ovens 105, each uptake duct 225 also includes an uptake damper 230. The uptake damper 230 can be positioned at any number of positions between fully open and fully closed to vary the amount of oven draft in the oven 105. The uptake damper 230 can comprise any automatic or manually-controlled flow control or orifice blocking device (e.g., any plate, seal, block, etc.). As used herein, "draft" indicates a negative pressure relative to atmosphere. For example a draft of 0.1 inches of water indicates a pressure of 0.1 inches of water below atmospheric pressure. Inches of water is a non-SI unit for pressure and is conventionally used to describe the draft at various locations in a coke plant. In some embodiments, the draft ranges from about 0.12 to about 0.16 inches of water. If a draft is increased or otherwise made larger, the pressure moves further below atmospheric pressure. If a draft is decreased, drops, or is otherwise made smaller or lower, the pressure moves towards atmospheric pressure. By controlling the oven draft with the uptake damper 230, the air flow into the oven 105 from the air inlets 190, 215, 227 as well as air leaks into the oven 105 can be controlled. Typically, as shown in FIG. 3, an individual oven 105 includes two uptake ducts 225 and two uptake dampers 230, but the use of two uptake ducts and two uptake dampers is not a necessity; a system can be designed to use just one or more than two uptake ducts and two uptake dampers.

A sample HHR coke plant 100 includes a number of ovens 105 that are grouped into oven blocks 235 (shown in FIG. 1). The illustrated HHR coke plant 100 includes five oven blocks 235 of twenty ovens each, for a total of one hundred ovens. All of the ovens 105 are fluidly connected by at least one uptake duct 225 to the common tunnel 110 which is in turn fluidly connected to each HRSG 120 by a crossover duct 115. Each oven block 235 is associated with a particular crossover duct 115. The exhaust gases from each oven 105 in an oven block 235 flow through the common tunnel 110 to the crossover duct 115 associated with each respective oven block 235. Half of the ovens in an oven block 235 are located on one side of an intersection 245 of the common tunnel 110 and a crossover duct 115 and the other half of the ovens in the oven block 235 are located on the other side of the intersection 245.

A HRSG valve or damper 250 associated with each HRSG 120 (shown in FIG. 1) is adjustable to control the flow of exhaust gases through the HRSG 120. The HRSG valve 250 can be positioned on the upstream or hot side of the HRSG 120, or can be positioned on the downstream or cold side of the HRSG 120. The HRSG valves 250 are variable to a number of positions between fully opened and fully closed and the flow of exhaust gases through the HRSGs 120 is controlled by adjusting the relative position of the HRSG valves 250.

In operation, coke is produced in the ovens 105 by first loading coal into the oven chamber 185, heating the coal in an oxygen depleted environment, driving off the volatile fraction of coal and then oxidizing the VM within the oven 105 to capture and utilize the heat given off. The coal volatiles are oxidized within the ovens over an extended coking cycle, and release heat to regeneratively drive the carbonization of the coal to coke. The coking cycle begins when the front door 165 is opened and coal is charged onto the oven floor 160. The coal on the oven floor 160 is known as the coal bed. Heat from the oven (due to the previous coking cycle) starts the carbonization cycle. As discussed above, in some embodiments, no additional fuel other than that produced by the coking process is used. Roughly half of the total heat transfer to the coal bed is radiated down onto the top surface of the coal bed from the luminous flame of the coal bed and the radiant oven crown 180. The remaining half of the heat is transferred to the coal bed by conduction from the oven floor 160 which is convectively heated from the volatilization of gases in the sole flue 205. In this way, a carbonization process "wave" of plastic flow of the coal particles and formation of high strength cohesive coke proceeds from both the top and bottom boundaries of the coal bed.

As the coal bed gets thicker, the actual time to process a ton of coal can increase. This occurs because the heat transfer through the coal cake is non-linear. The thicker the coal bed, the more time it takes for each ton of coal (or inch added) to be transformed into coke. Thus, the number of processing hours per ton coal is greater for a thicker coal bed than a thinner coal bed that has the same length and width. Consequently, to extend the cycle by employing a longer processing time, the production rate can be turned down by using a thicker coal bed.

Typically, each oven 105 is operated at negative pressure so air is drawn into the oven during the reduction process due to the pressure differential between the oven 105 and atmosphere. Primary air for combustion is added to the oven chamber 185 to partially oxidize the coal volatiles, but the amount of this primary air is controlled so that only a portion of the volatiles released from the coal are combusted in the oven chamber 185, thereby releasing only a fraction of their enthalpy of combustion within the oven chamber 185. The primary air is introduced into the oven chamber 185 above the coal bed through the primary air inlets 190 with the amount of primary air controlled by the primary air dampers 195. The primary air dampers 195 can also be used to maintain the desired operating temperature inside the oven chamber 185. The partially combusted gases pass from the oven chamber 185 through the downcomer channels 200 into the sole flue 205 where secondary air is added to the partially combusted gases. The secondary air is introduced through the secondary air inlet 215. The amount of secondary air that is introduced is controlled by the secondary air damper 220. As the secondary air is introduced, the partially combusted gases are more fully combusted in the sole flue 205, thereby extracting the remaining enthalpy of combustion which is conveyed through the oven floor 160 to add heat to the oven chamber 185. The fully or nearly-fully combusted exhaust gases exit the sole flue 205 through the uptake channels 210 and then flow into the uptake duct 225. Tertiary air is added to the exhaust gases via the tertiary air inlet 227, where the amount of tertiary air introduced is controlled by the tertiary air damper 229 so that any remaining fraction of uncombusted gases in the exhaust gases are oxidized downstream of the tertiary air inlet 227.

At the end of the coking cycle, the coal has coked out and has carbonized to produce coke. The coke is preferably removed from the oven 105 through the rear door 170 utilizing a mechanical extraction system. Finally, the coke is quenched (e.g., wet or dry quenched) and sized before delivery to a user.

FIG. 4 is a sectional view of a volatile matter/flue gas sharing system 445 configured in accordance with embodiments of the technology. As illustrated, four coke ovens 105A, 105B, 105C, and 105D (collectively "ovens 105") are fluidly connected to each other via connecting tunnels 405A, 405B, and 405C (collectively "connecting tunnels 405") and/or via the shared common tunnel 425. In some embodiments, at least one connecting tunnel control valve 410 and/or at least one shared tunnel control valve 435 can control the fluid flow between the connected coke ovens 105. In further embodiments, the system 445 can operate without control valves.

In some embodiments, adjacent ovens 105 are connected through an adjoining sidewall 175 or otherwise connected above the coal/coke level. Each connecting tunnel 405 extends through the shared sidewall 175 between two coke ovens 105. The connecting tunnel 405 provides fluid communication between the oven chambers 185 of adjacent coke ovens 105 and also provides fluid communication between the two oven chambers 185 and a downcomer channel 200 between the coke ovens. The flow of VM and hot gases between fluidly connected coke ovens 105 is controlled by biasing the oven pressure or oven draft in the adjacent coke ovens so that the hot gases and VM in the higher pressure (lower draft) coke oven 105 flow through the connecting tunnel 405 to the lower pressure (higher draft) coke oven 105. The VM to be transferred from the higher pressure (lower draft) coke oven can come from the oven chamber 185, the downcomer channel 200, or both the oven chamber 185 and the downcomer channel 200 of the higher pressure (lower draft) coke oven. In some embodiments, VM may primarily flow into the downcomer channel 200, but may intermittently flow into the oven chamber 185 as a "jet" of VM depending on the draft or pressure difference between the adjacent oven chambers 185. Delivering VM to the downcomer channel 200 provides VM to the sole flue 205. Draft biasing can be accomplished by adjusting the uptake damper or dampers 230 associated with each coke oven 105.

A connecting tunnel control valve 410 can be positioned in the connecting tunnel 405 to further control the fluid flow between two adjacent coke ovens 105. The control valve 410 includes a damper 415 which can be positioned at any of a number of positions between fully open and fully closed to vary the amount of fluid flow through the connecting tunnel 405. The control valve 410 can be manually controlled or can be an automated control valve. As will be described in further detail below, in some embodiments, the draft bias between the coke ovens 105 and within a coke oven 105 can be controlled by advanced controls, such as an automatic draft control system. In an advanced control system, an automated control valve 410 receives position instructions from a controller to move the damper 415 to a specific position.

In systems utilizing the shared tunnel 425, an intermediate tunnel 430 extends through the crown 180 of each coke oven 105 to fluidly connect the oven chamber 185 of that coke oven 105 to the shared tunnel 425. The flow of VM and hot gases between fluidly connected coke ovens 105 is controlled by biasing the oven pressure or oven draft in the adjacent coke ovens so that the hot gases and VM in the higher pressure (lower draft) coke oven flow through the shared tunnel 425 to the lower pressure (higher draft) coke oven. The flow of the VM within the lower pressure (higher draft) coke oven can be further controlled to provide VM to the oven chamber 185, to the sole flue 205 via the downcomer channel 200, or to both the oven chamber 185 and the sole flue 205. In further embodiments, the VM need not transfer via the downcomer channel 200.

Additionally, a shared tunnel control valve 435 can be positioned in the shared tunnel 425 to control the fluid flow along the shared tunnel (e.g., between coke ovens 105). The control valve 435 includes a damper 440 which can be positioned at any of a number of positions between fully open and fully closed to vary the amount of fluid flow through the shared tunnel 425. The control valve 435 can be manually controlled or can be an automated control valve. An automated control valve 435 receives position instructions to move the damper 440 to a specific position from a controller. In some embodiments, multiple control valves 435 are positioned in the shared tunnel 425. For example, a control valve 435 can be positioned between each adjacent coke ovens 105 or between groups of two or more coke ovens 105.

While all the ovens 105 are connected via the shared tunnel 425 in FIG. 4, in further embodiments more or fewer coke ovens 105 are fluidly connected by one or more shared tunnels 425. For example, the coke ovens 105 could be connected in pairs so that two coke ovens are fluidly connected by a first shared tunnel and the next two coke ovens are fluidly connected by a second shared tunnel, with no connection between non-paired ovens.

The volatile matter sharing system 445 provides two options for VM sharing: crown-to-downcomer channel sharing via a connecting tunnel 405 and crown-to-crown sharing via the shared tunnel 425. This provides greater control over the delivery of VM to the coke oven 105 receiving the VM. For instance, VM may be needed in the sole flue 205, but not in the oven chamber 185, or vice versa. Having separate tunnels 405 and 425 for crown-to-downcomer channel and crown-to-crown sharing, respectively, ensures that the VM can be reliably transferred to the correct location (i.e., either the oven chamber 185 or the sole flue 205 via the downcomer channel 200). The draft within each coke oven 105 is biased as necessary for the VM to transfer crown-to-downcomer channel and/or crown-to-crown, as needed. In further embodiments, only one of the connecting tunnel 405 or shared tunnel 425 is used to employ gas-sharing.

As discussed above, control of the draft between gas-sharing ovens can be implemented by automated or advanced control systems. An advanced draft control system, for example, can automatically control an uptake damper that can be positioned at any one of a number of positions between fully open and fully closed to vary the amount of oven draft in the oven 105. The automatic uptake damper can be controlled in response to operating conditions (e.g., pressure or draft, temperature, oxygen concentration, gas flow rate, downstream levels of hydrocarbons, water, hydrogen, carbon dioxide, or water to carbon dioxide ratio, etc.) detected by at least one sensor. The automatic control system can include one or more sensors relevant to the operating conditions of the coke plant 100. In some embodiments, an oven draft sensor or oven pressure sensor detects a pressure that is indicative of the oven draft. Referring to FIGS. 1-4 together, the oven draft sensor can be located in the oven crown 180 or elsewhere in the oven chamber 185. Alternatively, an oven draft sensor can be located at either of the automatic uptake dampers 305, in the sole flue 205, at either oven door 165 or 170, or in the common tunnel 110 near or above the coke oven 105. In one embodiment, the oven draft sensor is located in the top of the oven crown 180. The oven draft sensor can be located flush with the refractory brick lining of the oven crown 180 or could extend into the oven chamber 185 from the oven crown 180. A bypass exhaust stack draft sensor can detect a pressure that is indicative of the draft at the bypass exhaust stack 240 (e.g., at the base of the bypass exhaust stack 240). In some embodiments, a bypass exhaust stack draft sensor is located at the intersection 245. Additional draft sensors can be positioned at other locations in the coke plant 100. For example, a draft sensor in the common tunnel could be used to detect a common tunnel draft indicative of the oven draft in multiple ovens proximate the draft sensor. An intersection draft sensor can detect a pressure that is indicative of the draft at one of the intersections 245.

An oven temperature sensor can detect the oven temperature and can be located in the oven crown 180 or elsewhere in the oven chamber 185. A sole flue temperature sensor can detect the sole flue temperature and is located in the sole flue 205. A common tunnel temperature sensor detects the common tunnel temperature and is located in the common tunnel 110. A HRSG inlet temperature sensor can detect the HRSG inlet temperature and can be located at or near the inlet of the HRSG 120. Additional temperature or pressure sensors can be positioned at other locations in the coke plant 100.

An uptake duct oxygen sensor is positioned to detect the oxygen concentration of the exhaust gases in the uptake duct 225. An HRSG inlet oxygen sensor can be positioned to detect the oxygen concentration of the exhaust gases at the inlet of the HRSG 120. A main stack oxygen sensor can be positioned to detect the oxygen concentration of the exhaust gases in the main stack 145 and additional oxygen sensors can be positioned at other locations in the coke plant 100 to provide information on the relative oxygen concentration at various locations in the system.

A flow sensor can detect the gas flow rate of the exhaust gases. For example, a flow sensor can be located downstream of each of the HRSGs 120 to detect the flow rate of the exhaust gases exiting each HRSG 120. This information can be used to balance the flow of exhaust gases through each HRSG 120 by adjusting the HRSG dampers 250. Additional flow sensors can be positioned at other locations in the coke plant 100 to provide information on the gas flow rate at various locations in the system. Additionally, one or more draft or pressure sensors, temperature sensors, oxygen sensors, flow sensors, hydrocarbon sensors, and/or other sensors may be used at the air quality control system 130 or other locations downstream of the HRSGs 120.

An actuator can be configured to open and close the uptake damper 230. For example, an actuator can be a linear actuator or a rotational actuator. The actuator can allow the uptake damper 230 to be infinitely controlled between the fully open and the fully closed positions. The actuator can move the uptake damper 230 amongst these positions in response to the operating condition or operating conditions detected by the sensor or sensors included in an automatic draft control system. The actuator can position the uptake damper 230 based on position instructions received from a controller. The position instructions can be generated in response to the pressure, draft, temperature, oxygen concentration, gas flow rate, or downstream levels of hydrocarbons, water, hydrogen, carbon dioxide, or water to carbon dioxide ratio detected by one or more of the sensors discussed above, control algorithms that include one or more sensor inputs, a pre-set schedule, or other control algorithms. The controller can be a discrete controller associated with a single automatic uptake damper or multiple automatic uptake dampers, a centralized controller (e.g., a distributed control system or a programmable logic control system), or a combination of the two.

The automatic draft control system can, for example, control an automatic uptake damper of an oven 105 in response to the oven draft detected by an oven draft sensor. The oven draft sensor can detect the oven draft and output a signal indicative of the oven draft to a controller. The controller can generate a position instruction in response to this sensor input and the actuator can move the uptake damper 230 to the position required by the position instruction. In this way, an automatic control system can be used to maintain a targeted oven draft. Similarly, an automatic draft control system can control automatic uptake dampers, the HRSG dampers 250, and the draft fan 140, as needed, to maintain targeted drafts at other locations within the coke plant 100 (e.g., a targeted intersection draft or a targeted common tunnel draft). The automatic draft control system can be placed into a manual mode to allow for manual adjustment of the automatic uptake dampers, the HRSG dampers, and/or the draft fan 140, as needed. In still further embodiments, an automatic actuator can be used in combination with a manual control to fully open or fully close a flow path.

Figure 5:
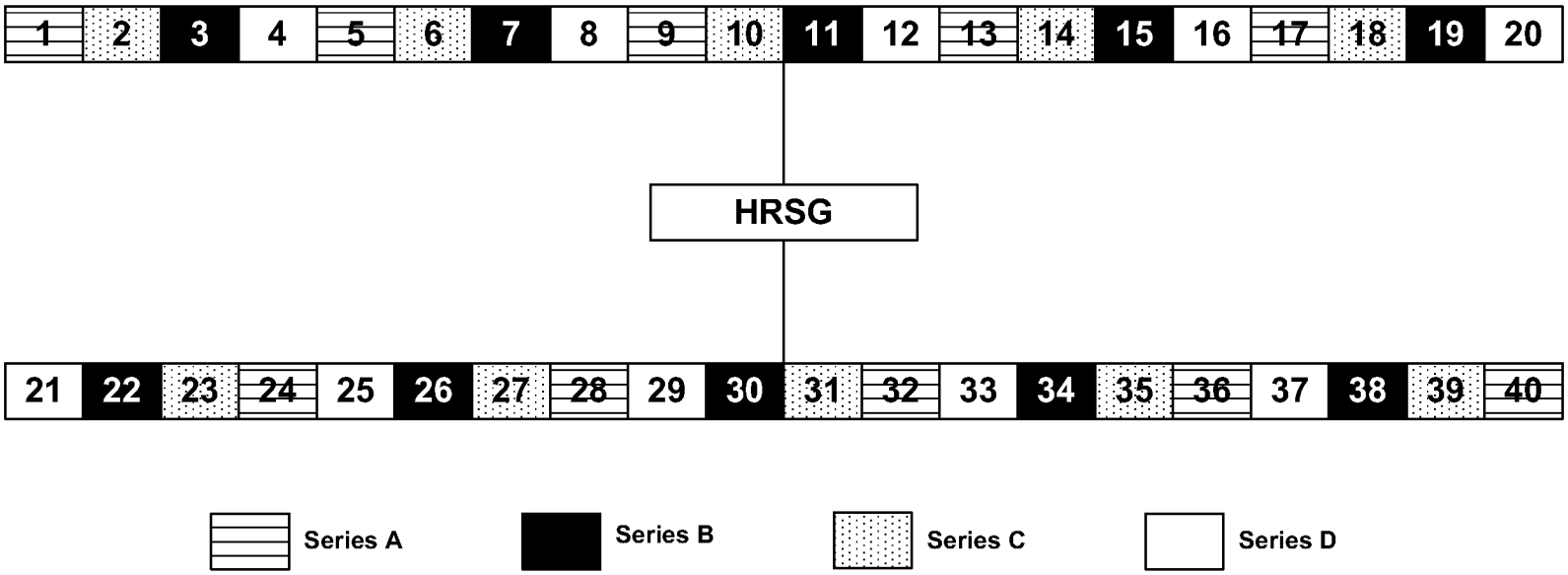
FIG. 5 is a schematic illustration of a group of coke ovens operating on an extended cycle and configured in accordance with embodiments of the technology.

FIG. 5 is a schematic illustration of a group of coke ovens (numbered 1-40) operating on an extended cycle and configured in accordance with embodiments of the technology. As discussed above, a coke plant can reduce output through gas sharing between ovens having extended, offset cycles. In the illustrated coke plant, the ovens run on an approximately 96-hour cycle. The ovens are pushed in sequential series, where ovens illustrated as being in Series B are pushed 24 hours after ovens in Series A are pushed. Series C ovens are likewise pushed 24 hours after Series B ovens and Series D ovens are pushed 24 hours after Series C ovens. The Series C ovens are therefore pushed 48 hours into the Series A cycle, and can share volatile matter and flue gas with the Series A ovens, thereby extending the cycle of the Series A ovens in the manner described above. Series B and D ovens can likewise operate as gas-sharing partners. This sequence repeats itself to provide for continuous operation and gas-sharing partners. In further embodiments, the gas sharing may take place between ovens that are not immediately adjacent (i.e., there may be non-sharing ovens positioned between two gas-sharing ovens). In still further embodiments, the cycles need not necessarily be opposite, but may be offset to other degrees that still allow sufficient gas sharing to extend the oven cycles to the desired length. In other embodiments, different ovens within a block need not have the same cycle length. More specifically, some ovens may be on an extended cycle while other ovens are not. For example, in some embodiments, an extended-cycle oven may be adjacent to and in gas-sharing communication with a non-extended cycle oven. While the forty illustrated coke ovens are shown as being connected to a single HRSG, in further embodiments there can be more or fewer ovens and more or fewer HRSGs.

Figure 6:
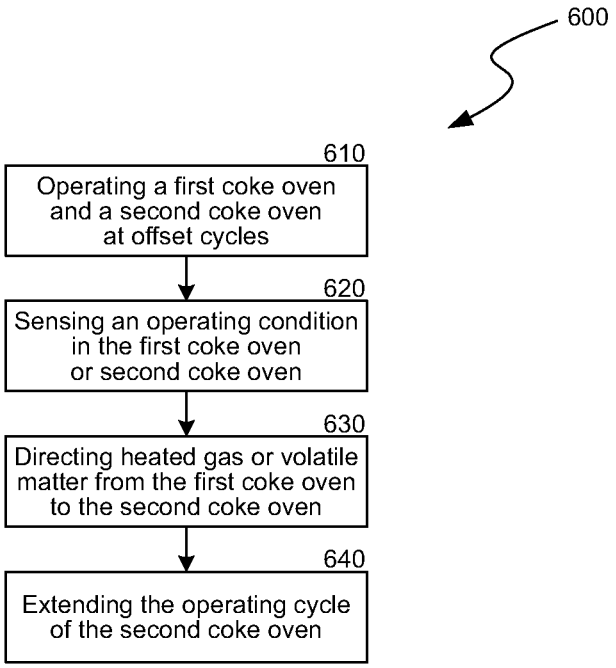
FIG. 6 is a block diagram of a method of gas sharing between coke ovens to decrease a coke production rate in accordance with embodiments of the technology.

FIG. 6 is a block diagram of a method 600 of gas sharing between coke ovens to decrease a coke production rate in accordance with embodiments of the technology. The method 600 includes operating a first coke oven and a second coke oven at offset cycles (block 610). As discussed above, in some embodiments the offset cycles are approximately opposite cycles, so that the second oven begins its cycle halfway through the first oven's cycle. The method 600 can further include sensing an operating condition in the first coke oven or the second coke oven (block 620). In some embodiments, one or more of a pressure, draft, temperature, oxygen concentration, gas flow rate, or downstream levels of hydrocarbons, water, hydrogen, carbon dioxide, or water to carbon dioxide ratio condition can be sensed.

The method 600 can include directing heated gas or VM from the first coke oven to the second coke oven (block 630). In some embodiments, directing the heated gas from the first coke oven to the second coke oven comprises biasing the draft from the first oven to the second oven via a shared external tunnel or via an internal exhaust duct through a shared wall of the ovens. In some embodiments, the biasing comprises adjusting an uptake damper in the ovens that is coupled to the shared gas duct. The biasing can be automatic in response to the operating condition sensing described above, manually, or as part of a pre-selected uptake damper adjustment schedule.

The method 600 further includes extending the operating cycle of the second coke oven (block 640). In some embodiments, the cycle is extended to be 72 or more hours. Because of the heated gas and VM supplied to the second oven, the second oven can maintain operation within a pre-selected temperature range (i.e., above a critical temperature). In some embodiments, the method 600 is performed without supplementing heat to the coke ovens from an external source. In further embodiments, natural gas is used to supplement the heat. The method 600 can be performed on loose or stamp-charged coal, formed coal, or coal briquettes.

While the method 600 has been described as a way of reducing output by extending a coking cycle for a typical coal push, in other embodiments the output can be reduced by reducing the size of the coal push. For example, a "short fill", having a weight of approximately 10-40% below the maximum designed fill, can be pushed in a coke oven. Gas sharing can be used between proximate ovens in the manner described above to maintain oven temperature for the reduced load size.

EXAMPLES

1. A method of gas sharing between coke ovens to decrease a coke production rate, the method comprising:
   - operating a plurality of coke ovens to produce coke and exhaust gases, wherein each coke oven comprises an uptake damper adapted to control an oven draft in the coke oven, and wherein a first coke oven is offset in operation cycle from a second coke oven;
   - directing the exhaust gases from the first coke oven to a shared gas duct that is in communication with the first coke oven and the second coke oven; and
   - biasing the draft in the ovens to move the exhaust gas from the first coke oven to the second coke oven via the shared gas duct to transfer heat from the first coke oven to the second coke oven.

2. The method of example 1 wherein operating a plurality of coke ovens comprises operating the first coke oven and the second coke oven on opposite operating cycles, wherein the first coke oven begins an operating cycle when the second coke oven is approximately halfway through an operating cycle.

3. The method of example 1 wherein directing the exhaust gases from the first coke oven to a shared gas duct comprises directing the exhaust gases from the first coke oven to a shared tunnel external to and fluidly connecting the ovens.

4. The method of example 1 wherein directing the exhaust gases from the first coke oven to a shared gas duct comprises directing the exhaust gases from the first coke oven to the second coke oven via an exhaust duct in a common internal wall of the first coke oven and the second coke oven.

5. The method of example 1 wherein biasing the draft in the ovens comprises adjusting an uptake damper coupled to the shared gas duct.

6. The method of example 5, further comprising sensing one or more of a pressure, draft, temperature, oxygen concentration, hydrocarbon level, levels of water, hydrogen, carbon dioxide, or water to carbon dioxide ratio, or gas flow rate condition and automatically adjusting a position of the uptake damper in response to the sensing.

7. The method of example 1 wherein the method is performed without supplementing heat to the coke ovens from an external source.

8. The method of example 1, further comprising supplementing heat to the second coke oven with natural gas.

9. The method of example 1 wherein operating a plurality of coke ovens comprises operating the first coke oven and the second coke oven over operation cycles lasting 72 hours or more.

10. The method of example 1 wherein biasing the draft in the ovens to move the exhaust gas from the first coke oven to the second coke oven comprises moving gas and volatile matter from the first coke oven to the second coke oven.

11. The method of example 1, further comprising pushing loose or stamp-charged coal into the first coke oven.

12. A method of controlling a quantity of coke production in a heat recovery coke oven, the method comprising:

operating a first coke oven having a first uptake damper to a common duct, wherein the first coke oven operates on a first operating cycle, the operating cycle lasting at least 72 hours, operating a second coke oven having a second uptake damper to the common duct, wherein the second coke oven operates on a second operating cycle, the second operating cycle beginning at a time approximately halfway through the first operating cycle; and transferring heated gas and volatile matter through the common duct from the first coke oven to the second coke oven.

13. The method of example 12 wherein transferring heated gas and volatile matter from the first coke oven to the second coke oven comprises extending a cycle of operation of the second coke oven.

14. The method of example 12, further comprising sensing a pressure or temperature condition in the second coke oven.

15. The method of example 14 wherein transferring heated gas and volatile matter from the first coke oven to the second coke oven comprises automatically transferring the heated gas and the volatile matter based on the sensing in order to maintain the second coke oven within a pre-selected temperature range.

16. The method of example 15 wherein automatically transferring the heated gas and volatile matter comprises automatically adjusting at least one of the first uptake damper or the second uptake damper in response to the sensing.

17. The method of example 12 wherein operating the first coke on a first operating cycle lasting at least 72 hours comprises operating the first coke oven on an operating cycle lasting at least 96 hours.

18. The method of example 12 wherein transferring heated gas and volatile matter from the first coke oven to the second coke oven comprises automatically transferring the heated gas and the volatile matter based a pre-selected schedule.

19. A method of decreasing a rate of coke production, the method comprising:

pushing a load of coal into a first coke oven, the first coke oven having a maximum designed production rate comprising a ratio of a maximum designed charge weight to a maximum designed cycle time;

while the first coke oven is in operation, pushing a load of coal into a second coke oven proximate to the first coke oven;

directing heated gas from the second coke oven to the first coke oven; and extracting coke from the first coke oven at a production rate at least 15% below the maximum designed production rate.

20. The method of example 19 wherein directing heated gas from the second coke oven to the first coke oven comprises directing gas via at least one of a shared external tunnel or a shared internal oven passageway.

21. The method of example 19, further comprising sensing at least one of a temperature or pressure condition in the first coke oven.

22. The method of example 21, further comprising automatically directing heated gas from the second coke oven to the first coke oven in response to the sensing.

23. The method of claim 19 wherein extracting coke from the first coke oven at a production rate at least 15% below the maximum designed production rate comprises extracting coke from the first coke oven at a production rate at least 30% below the maximum designed production rate.

The systems and methods disclosed herein offer several advantages over traditional systems. By extending the processing time for a push of coal, a plant is able to limit production to generate only the demanded quantity of coke without turning off the ovens altogether, which would potentially damage the structural integrity of the ovens. The longer cycles mean that there are fewer coal pushes which corresponds to lower staffing costs and lower operational costs for downstream machinery that is running at a lower rate. Further, coal having a higher percentage of VM can be used in the extended cycle as compared to traditional 24 or 48-hour cycles, and the higher VM coal is cheaper than lower VM coal. The longer cycle time also increases the maintenance window for repairs that need to be completed between successive pushes.

From the foregoing it will be appreciated that, although specific embodiments of the technology have been described herein for purposes of illustration, various modifications may be made without deviating from the spirit and scope of the technology. For example, the techniques described herein can be applied to loose or stamp-charged coal, formed coal, or coal briquettes. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A method of gas sharing between coke ovens to decrease a coke production rate, the method comprising:

operating a plurality of coke ovens to produce coke and exhaust gases, wherein each coke oven comprises an uptake damper adapted to control an oven draft in the coke oven, and wherein a first coke oven is offset in coking cycle from a coking cycle of a second coke oven;

directing at least a portion of the exhaust gases from the first coke oven to a shared gas duct that is in communication with the first coke oven and the second coke oven; and biasing the draft in the ovens to move the exhaust gas from the first coke oven to the second coke oven via the shared gas duct to transfer heat from the first coke oven to the second coke oven, such that the coking cycle of the second coke oven is extended, which decreases a coke production rate for the second coke oven.

2. The method of claim 1 wherein operating a plurality of coke ovens comprises operating the first coke oven and the second coke oven on opposite coking cycles, wherein the first coke oven begins a coking cycle when the second coke oven is approximately halfway through a coking cycle.

3. The method of claim 1 wherein directing the exhaust gases from the first coke oven to a shared gas duct comprises directing the exhaust gases from the first coke oven to a shared tunnel external to and fluidly connecting the ovens.

4. The method of claim 1 wherein directing the exhaust gases from the first coke oven to a shared gas duct comprises directing the exhaust gases from the first coke oven to the second coke oven via an exhaust duct in a common internal wall of the first coke oven and the second coke oven.

5. The method of claim 1 wherein biasing the draft in the ovens comprises adjusting an uptake damper coupled to the shared gas duct.

6. The method of claim 5, further comprising sensing one or more of a pressure, draft, temperature, oxygen concentration, hydrocarbon level, levels of water, hydrogen, carbon dioxide, or water to carbon dioxide ratio, or gas flow rate condition and automatically adjusting a position of the uptake damper in response to the sensing.

7. The method of claim 1 wherein the method is performed without supplementing heat to the coke ovens from an external source.

8. The method of claim 1, further comprising supplementing heat to the second coke oven with natural gas.

9. The method of claim 1 wherein operating a plurality of coke ovens comprises operating the first coke oven and the second coke oven over coking cycles lasting 72 hours or more.

10. The method of claim 1 wherein biasing the draft in the ovens to move the exhaust gas from the first coke oven to the second coke oven comprises moving gas and volatile matter from the first coke oven to the second coke oven.

11. The method of claim 1, further comprising pushing loose or stamp-charged coal into the first coke oven.

12. A method of controlling a quantity of coke production in a heat recovery coke oven, the method comprising:

operating a first coke oven having a first uptake damper fluidly coupled with a common duct, wherein the first coke oven operates on a first coking cycle;

operating a second coke oven having a second uptake damper fluidly coupled with the common duct, wherein the second coke oven operates on a second coking cycle, the second coking cycle beginning at a time approximately halfway through the first coking cycle; and the second coking cycle designed to last less than 72 hours; and transferring heated gas and volatile matter through the common duct from the first coke oven to the second coke oven, such that the second coking cycle lasts 72 hours or more.

13. The method of claim 12 wherein transferring heated gas and volatile matter from the first coke oven to the second coke oven comprises extending a coking cycle of the second coke oven and decreasing a designed coke production rate for the second coke over.

14. The method of claim 12, further comprising sensing a pressure or temperature condition in the second coke oven.

15. The method of claim 14 wherein transferring heated gas and volatile matter from the first coke oven to the second coke oven comprises automatically transferring the heated gas and the volatile matter based on the sensing in order to maintain the second coke oven within a pre-selected temperature range.

16. The method of claim 15 wherein automatically transferring the heated gas and volatile matter comprises automatically adjusting at least one of the first uptake damper or the second uptake damper in response to the sensing.

17. The method of claim 12 wherein the second coking cycle lasts at least 96 hours.

18. The method of claim 12 wherein transferring heated gas and volatile matter from the first coke oven to the second coke oven comprises automatically transferring the heated gas and the volatile matter based a pre-selected schedule.

19. A method of decreasing a rate of coke production, the method comprising:

pushing a load of coal into a first coke oven, the first coke oven having a maximum designed production rate comprising a ratio of a maximum designed charge weight to a maximum designed coking cycle time;

operating the first coke oven by initiating the coking cycle;

while the first coke oven is in operation, pushing a load of coal into a second coke oven proximate to the first coke oven;

operating the second coke over by initiating the coking cycle;

directing heated gas from the second coke oven to the first coke oven such that the maximum designed coking cycle time of the first coke oven is extended; and extracting coke from the first coke oven at a production rate at least 15% below the maximum designed production rate.

20. The method of claim 19 wherein directing heated gas from the second coke oven to the first coke oven comprises directing gas via at least one of a shared external tunnel or a shared internal oven passageway.

21. The method of claim 19, further comprising sensing at least one of a temperature or pressure condition in the first coke oven.

22. The method of claim 21, further comprising automatically directing heated gas from the second coke oven to the first coke oven in response to the sensing.

23. The method of claim 19 wherein coke is extracted from the first coke oven at a production rate at least 30% below the maximum designed production rate.

* * * * *

UNITED STATES PATENT AND TRADEMARK OFFICE

CERTIFICATE OF CORRECTION

PATENT NO. : 9,193,913 B2
APPLICATION NO. : 13/730692
DATED : November 24, 2015
INVENTOR(S) : John Francis Quanci et al.

It is certified that error appears in the above-identified patent and that said Letters Patent is hereby corrected as shown below:

IN THE CLAIMS

In column 15, line 35, in claim 12, delete "and the" and insert -- the --, therefor.

In column 15, line 45, in claim 13, delete "over." and insert -- oven. --, therefor.

In column 16, line 15, in claim 18, delete "a" and insert -- on --, therefor.

In column 16, line 26, in claim 19, delete "over" and insert -- oven --, therefor.

Signed and Sealed this
Twenty-ninth Day of March, 2016

Michelle K. Lee

Michelle K. Lee
*Director of the United States Patent and Trademark Office*